United States Patent [19]

Ferguson et al.

[11] Patent Number: 4,807,418

[45] Date of Patent: Feb. 28, 1989

[54] PEDESTAL MOUNTED HOUSE AND METHOD

[76] Inventors: Jean C. Ferguson, Rte. 1 Box 186, Banner Elk, N.C. 28604; Tilmoth H. Inman, II, P.O. Box 396, Linville, N.C. 28646

[21] Appl. No.: 86,913

[22] Filed: Aug. 19, 1987

[51] Int. Cl.[4] ..... E04B 1/34

[52] U.S. Cl. ..... 52/747; 52/169.4; 52/309.11; 52/73

[58] Field of Search ..... 52/73, 309.11, 747, 52/745, 169.4

[56] References Cited

U.S. PATENT DOCUMENTS

| | | | |
|---|---|---|---|
| 1,529,516 | 3/1925 | Thorne | 52/73 |
| 3,633,325 | 1/1972 | Bartoli | 52/73 |
| 3,712,004 | 1/1973 | Loebsack | 52/309.11 |
| 3,815,300 | 6/1974 | Bain | 52/73 |
| 3,955,328 | 5/1976 | Lindsay | 52/73 |

FOREIGN PATENT DOCUMENTS

| | | | |
|---|---|---|---|
| 1269321 | 7/1961 | France | 52/73 |

*Primary Examiner*—Henry E. Raduazo
*Attorney, Agent, or Firm*—W. Thad Adams, III

[57] ABSTRACT

A method of constructing a house of the type mounted on a pedestal. The house has exterior walls which overhang the perimeter of the pedestal on at least two sides thereof to define at least one vertically unsupported corner and is characterized by permitting the unsupported corner or corners of the house to transmit floor, wall and roof loads laterally inwardly to supporting members. The method includes the steps of constructing a pedestal to support the house above grade, and then constructing a floor truss system from a plurality of intersecting trusses mounted on the pedestal, the truss system extending outwardly beyond the perimeter of the pedestal on at least two sides to define at least one corner area not supported for vertical load transfer. Then, a floor is secured to the floor truss system, the floor being constructed of connected-together stress skin panels comprising a core of expanded polystyrene bonded to and sandwiched between relatively thin sheathing. Exterior walls are erected around the perimeter of the floor truss system and onto the floor to define the enclosure of the house, the exterior walls being constructed of stress skin construction panels connected-together to form an integral load-bearing structure supporting its own weight, and the weight of the unsupported corners and transferring the weight thus supported laterally to the load-bearing floor trusses and pedestal.

5 Claims, 4 Drawing Sheets

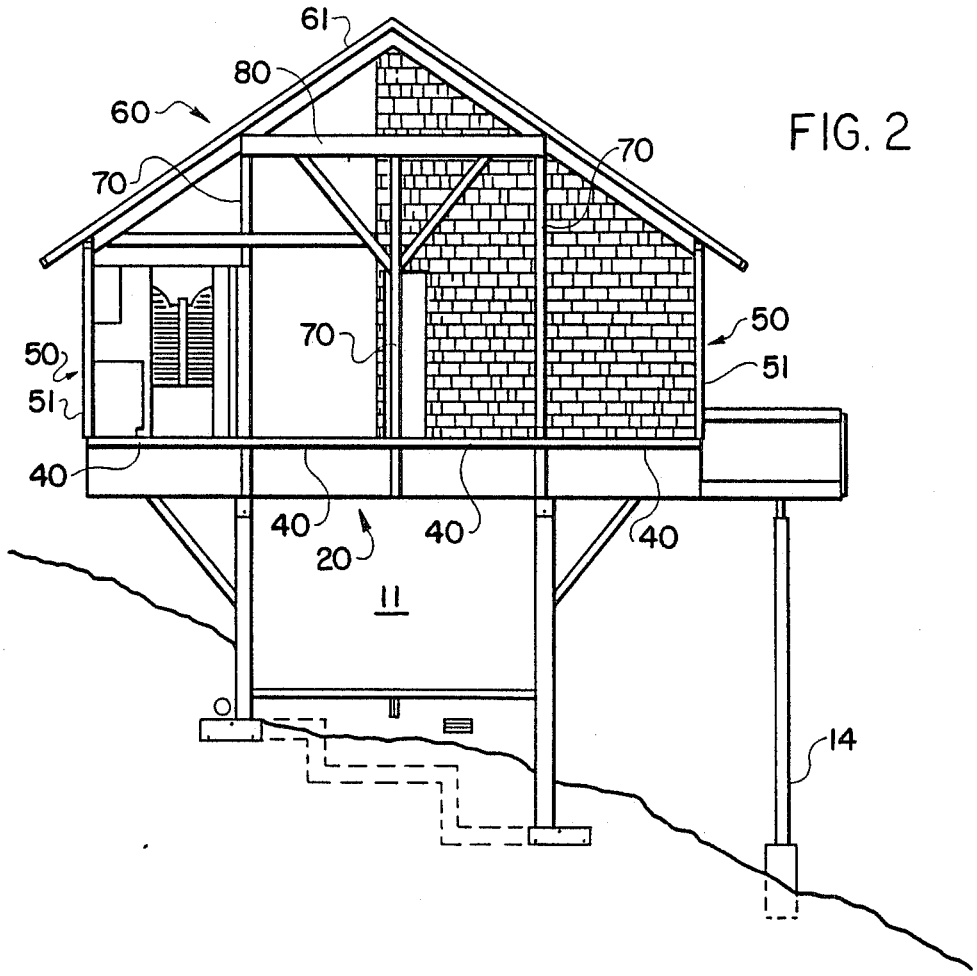
FIG. 2
FIG. 7
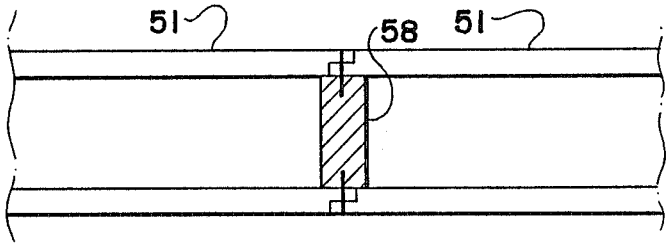

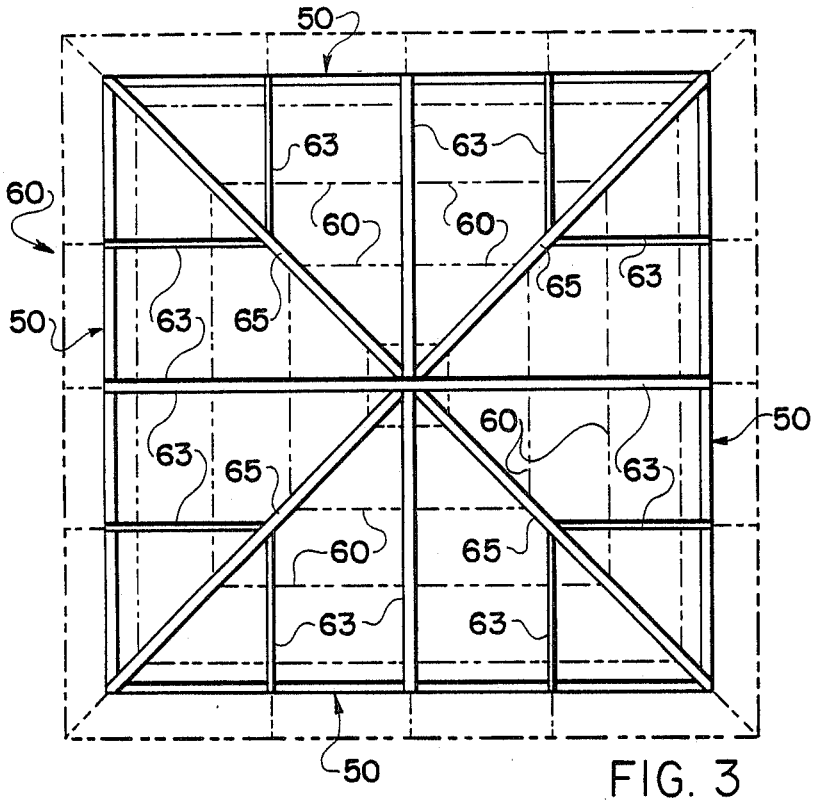
FIG. 3
FIG. 4
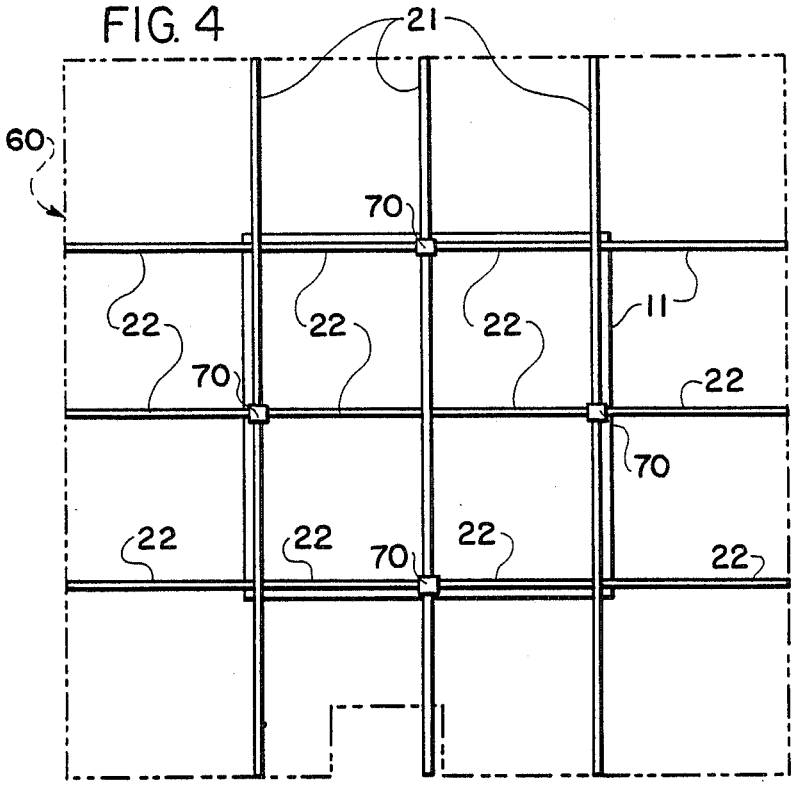

PEDESTAL MOUNTED HOUSE AND METHOD

TECHNICAL FIELD AND BACKGROUND OF THE INVENTION

This invention relates to a pedestal mounted house and a method of constructing the house. The particular type of house disclosed in this application is that type in which the floor walls and roof are secured to a pedestal. The pedestal may be of the type formed by a series of spaced-apart pilings or piers, or may be the type formed by an enclosed wall of blocks or bricks. The type disclosed in this application is the enclosed wall type for purposes of illustration, and is shown supporting a square living area. Houses of this general type are very often found in resort areas, such as in the mountains.

In prior art houses of this type the corners must be supported, typically by separate structural columns which extend straight down into the ground from beneath the corners. All wall and floor leads are transmitted vertically into the floor trusses which transmit the loads to the pedestal. This increases the cost of the structure and detracts from its aesthetic qualities. Alternatively, pedestal type houses simply omit the corners altogether, thereby providing a living area which is in the shape of a cross. This greatly decreases the amount of livable space that can be placed onto the pedestal.

Typically, such houses are "stick built", meaning that the house is constructed on site from stick lumber which is cut to size according to the building plans. In such construction, load bearing members, usually columns, support the majority of the weight of the structure. The exterior and interior walls support only their own weight and a minimal amount of the roof weight. More recently, such houses have been constructed of building panels which replace certain parts of the stick built wall, floor and roof sections as a means of providing an airtight structure with good insulation. These panels are referred to as stress-skin panels and comprise a thick core of rigid EPS expanded polystyrene insulation which is adhesively welded between stranded lumber or wafer board facings or sheaths. This forms an integral structure that will not twist or warp and has about twice the strength of stick-built construction.

By utilizing stress skin panels in a new and more extensive manner to its maximum capacity, vertically unsupported corners can be supported by a properly loaded, integral wall and roof system.

SUMMARY OF THE INVENTION

Therefore, it is an object of the invention to provide a method of constructing a pedestal-type house with vertically unsupported corners.

It is another object of the invention to provide a method of constructing a house which uses stress skin building panels to form the floor, walls and roof into an integral unit.

It is another object of the invention to provide a method of constructing a house which uses stress skin building panels to form a wall which will support vertically unsupported building corners.

It is yet another object of the invention to provide a house which exhibits the characteristics achieved by construction according to the method of the invention.

These and other objects of the present invention are achieved in the preferred embodiments disclosed below by providing a method of constructing a house of the type mounted on a pedestal, the house having exterior walls which overhang the perimeter of the pedestal on at least two sides thereof to define at least one vertically unsupported corner. The house is characterized by permitting the unsupported corner or corners of the house to transmit floor, wall and roof loads laterally inwardly to supporting members. The method comprises the steps of constructing a pedestal to support the house above grade and a floor truss system from a plurality of intersecting trusses mounted on the pedestal. The truss system extends outwardly beyond the perimeter of the pedestal on at least two sides to define at least one corner area not supported for vertical load transfer.

A floor is constructed onto the floor truss system, the floor being constructed of connected-together stress skin panels comprising a core of expanded polystyrene bonded to and sandwiched between relatively thin sheathing.

Exterior walls are erected around the perimeter of the floor truss system and onto the floor to define the enclosure of the house. The exterior walls are constructed of stress skin construction panels connected-together to form an integral load-bearing structure supporting its own weight and the weight of the unsupported corners. The weight thus supported is transferred laterally to the load-bearing floor trusses and pedestal.

A roof is constructed onto the top of the exterior walls, the roof being constructed of connected-together stress skin construction panels mounted on rafters secured to the top of the exterior walls. The rafters are mounted on vertical load-bearing columns supported by the pedestal and on the walls.

According to one preferred embodiment of the invention, the floor truss system is constructed to extend outwardly beyond the perimeter of the pedestal on four sides to define four corner areas not supported for vertical load transfer.

According to another preferred embodiment of the invention, the floor truss system is constructed to extend outwardly beyond the perimeter of the pedestal symmetrically on four sides to define four symmetrical corners areas not supported for vertical load transfer.

Preferably, the step of connecting together the wall panels comprises recessing the polystyrene core from the edge of the sheathing along the entire length of the panel to a depth sufficient for the recesses of adjacent panels to collectively receive a spline therebetween for being secured to the panels.

According to another preferred embodiment of the invention, the step of connecting together the wall panels comprises the step of providing mating lap joints along the edge of the sheathing material for overlapping adjoining wall panel edges and securing the wall panels in overlapping relation to the spline.

In the house constructed in accordance with the method of the invention, the house has exterior walls which overhang the perimeter of a pedestal on at least two sides thereof to define at least one vertically unsupported corner. The house is characterized by permitting the unsupported corner or corners of the house to transmit floor, wall and roof loads laterally inwardly to supporting members.

The house includes a pedestal for supporting the house above grade, with a floor truss system constructed from a plurality of intersecting trusses mounted on the pedestal. The truss system extends outwardly beyond the perimeter of the pedestal on at least two sides to define at least one corner area not supported for vertical load transfer.

A floor is constructed onto the floor truss system. The floor is constructed of connected-together stress skin panels comprising a core of expanded polystyrene bonded to and sandwiched between relatively thin sheathing;

Exterior walls extend around the perimeter of the floor truss system and are secured to the floor to define the enclosure of the house. The exterior walls are constructed of stress skin construction panels connected-together to form an integral load-bearing structure supporting its own weight and the weight of the unsupported corners. The weight thus supported is transferred laterally to the load-bearing floor trusses and pedestal.

A roof is secured to the top of the exterior walls. The roof is constructed of connected-together stress skin construction panels mounted on rafters secured to the top of the exterior walls. The rafters are mounted on vertical load-bearing columns supported by the pedestal and on the walls.

According to one preferred embodiment of the invention, the floor truss system extends outwardly beyond the perimeter of the pedestal on four sides to define four corner areas not supported for vertical load transfer.

According to another preferred embodiment of the invention, the floor truss system extends outwardly beyond the perimeter of the pedestal symmetrically on four sides to define four symmetrical corner areas not supported for vertical load transfer.

According to one preferred embodiment of the invention, the wall panels include recesses in the polystyrene core from the edge of the sheathing along the entire length of the panel to a depth sufficient for the recesses of adjacent panels to collectively receive a spline therebetween for being secured to the panels.

According to yet another embodiment of the invention, the wall panels include mating lap joints along the edge of the sheathing material for overlapping adjoining wall panel edges and securing the wall panels in overlapping relation to the spline.

BRIEF DESCRIPTION OF THE DRAWINGS

Some of the objects of the invention have been set forth above. Other objects and advantages of the invention will appear as the description of the invention proceeds when taken in conjunction with the following drawings, in which:

FIG. 2 is a side elevation in partial cross-section of the structure in FIG. 1;

FIG. 3 is a plan view of the roof framing;

FIG. 4 is a plan view of the floor plan;

FIG. 7 is a horizontal cross-section showing attachment of adjacent wall panels together.

DESCRIPTION OF THE PREFERRED EMBODIMENT

Figure 1:
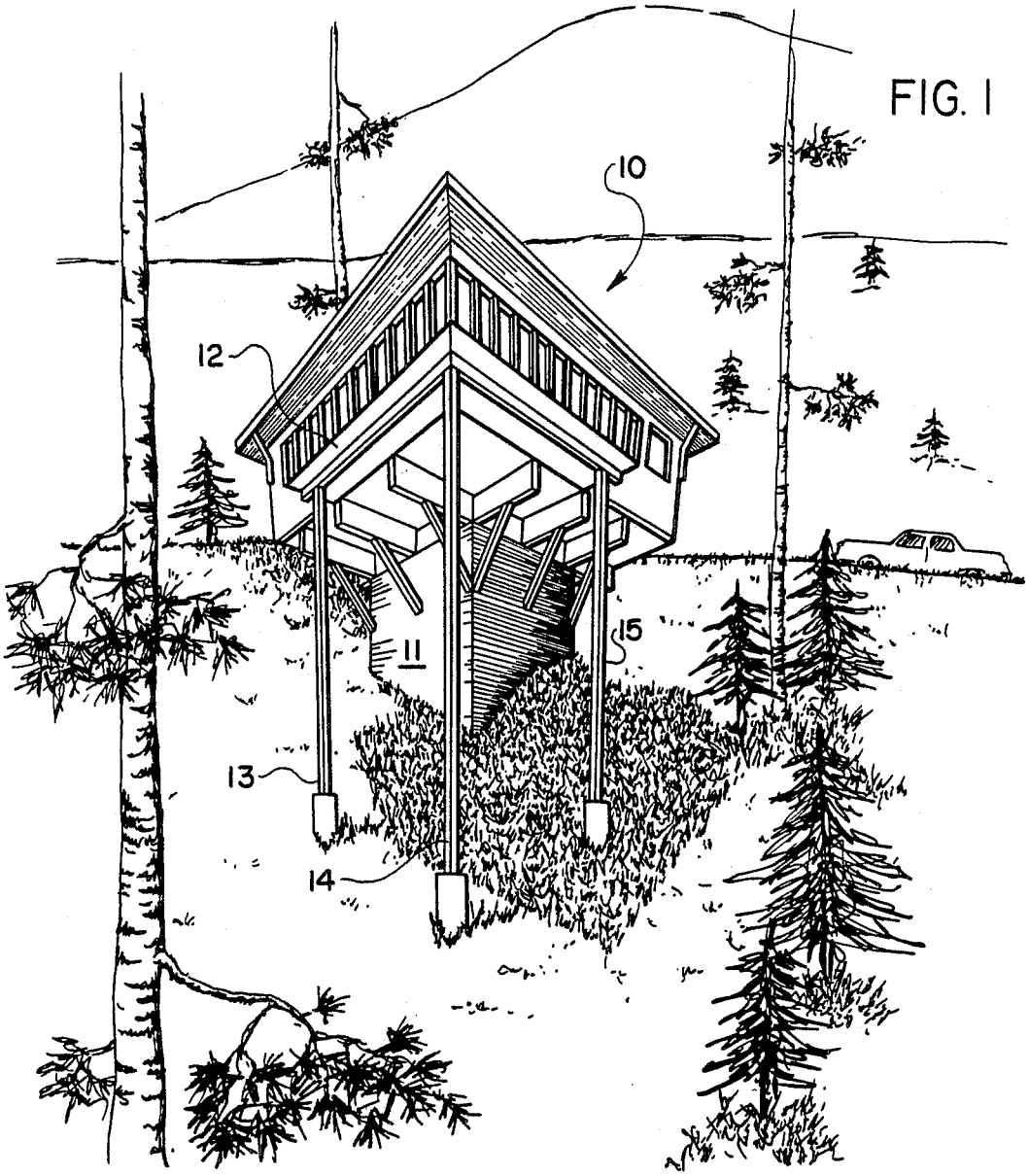
FIG. 1 is a perspective, environmental, view of a house constructed in accordance with the present invention, and including a non structure-supporting porch attached to one side.

Referring now specifically to the drawings, a house according to the present invention is illustrated in FIG. 1 and shown generally at reference numeral 10. The particular house shown is one of the type which could be typically built in resort areas for weekend or vacation use, such as in the mountains. The house 10 is erected on a pedestal 11. This type of foundation is particularly adapted for mountain construction, since it permits a structure having a relatively small perimeter to support a house having a much greater perimeter.

In the house shown in FIG. 1, the invention disclosed herein permits the wall and floor loads on the corners of the house to be structurally supported by lateral transmission of the loads to trusses remote from the corners, and then vertically to the pedestal. Houses of this type are very often built with porches, and house 10 in FIG. 1 shows such a porch 12, which extends from one corner partially along two walls. The porch 12 is supported by three columns 13, 14 and 15 anchored into the ground below the portion 12. It should be emphasized that the porch 12 and the columns 13–15 *do not* provide structural support to the adjacent corner of the house 10 and are not necessary for structural reasons, as is evident by the fact that the other three corners of the house 10 are free standing.

Referring now to FIG. 2, house 10 is shown in partial cross-section. A web truss system 20 rests on the pedestal 11 and supports 4′×12′ EPS oriented strand board floor stressed skin panels 40. The exterior walls 50 are constructed of EPS T-111 laminated grooved planking stressed skin panels 51. The roof 60 is supported by Y-columns 70 (three shown) and an attached square compression ring 80. The roof 60 is formed of 6″ thick EPS stressed skin panels 61 having a top skin of oriented strand board and a bottom skin of T-111 laminated grooved planking.

Figure 6:
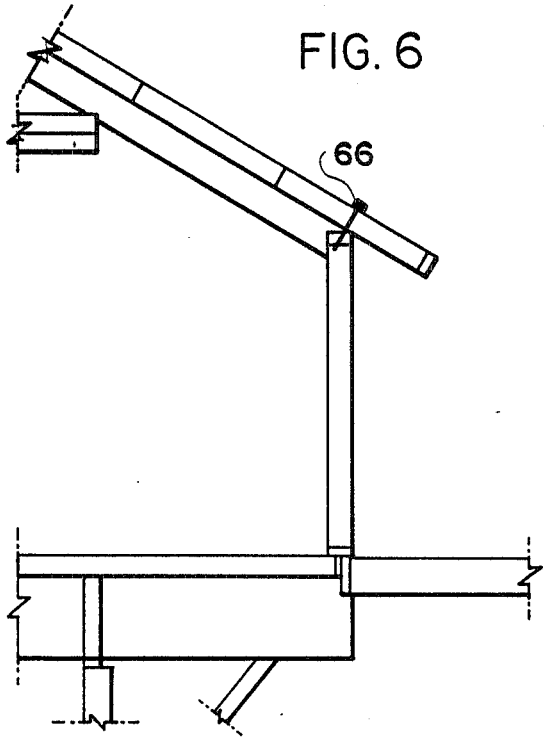
FIG. 6 is a cross-section showing attachment of the roof to the exterior walls.

Further detail of the roof construction is shown in FIG. 3. Rafters 63 connect the top surface of exterior walls 50 and diagonally extending hip rafters 65. As is shown in FIG. 6, a bolt 66 is used to fasten each rafter 63 or 65 to walls 50. In the embodiment shown, 24 of the panels 61 are full size, with the remaining panels 61 being cut to shape to fit the size of the roof, as is indicated by the phantom lines 66. The roof panels 61 are attached to the rafters 63 and 65 with annular threaded screws.

The web truss system 20 is shown in FIG. 4. Trusses 21 extend the length of the house 10 from one end to the other and provide primary support for the rest of the structure. Cross trusses 22 provide the remainder of the support. The floor panels 40 are secured to the trusses 21 and 22 with annular threaded screws.

Figure 5:
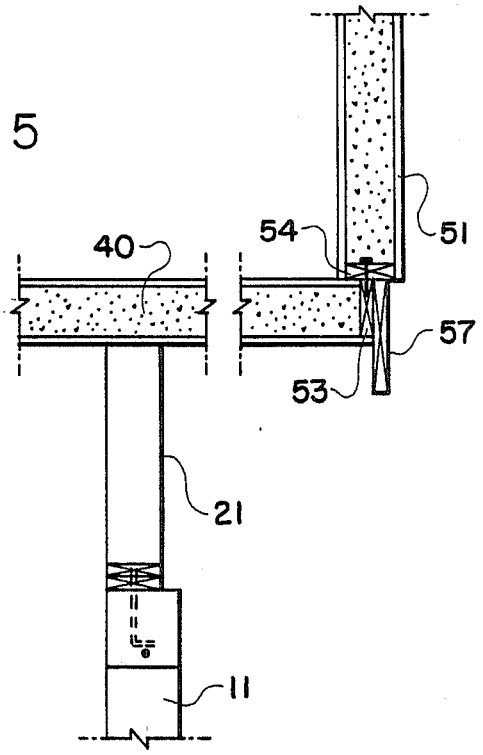
FIG. 5 is a cross-section showing attachment of the exterior walls to the floor.

Referring now to FIG. 5, the method of attachment of the wall panels 51 to the floor panels is shown. A 2″×6″ western spruce cord 53 is mounted to the end of floor panel 40. A 2″×6″ yellow pine shoe 54 is attached to the cord 53 with $\frac{5}{8}$″×4″ lag bolts. The lower end of each panel 51 is recessed and fits over the shoe 54. The skins of each panel 51 are attached to the shoe 54 with 8″ long threaded fasteners. A floor band 57 encloses this structure.

Adjacent wall panels 51 are secured together by providing a unique structure and joining method. The foam core portion along the side edges of each panel 51 is recessed $\frac{3}{4}$″ to receive, when joined together side-toside, a $1\frac{1}{2}''$ yellow pine spline 58 which is secured to shoe 54 and rafters 63 or 65. The spline 58 therefore overlaps the adjacent panels 51. The side edges of the inner and outer skins are routed to provide mating, overlapping edges, as is shown. A secure, rigid, unitary structure results when nails are driven through the overlapped side edges of the panels 51 and into the spline 58.

The use of stressed skin EPS panels for the floor, walls and roof in the manner described above provides a very stable and rigid structure. The load bearing capacity is sufficient to support the corners of the house 10 without vertical support, the loads being transmitted laterally from the corners to the nearest truss 21 or 22, and then to the pedestal 11.

A house and a method of constructing a house is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. A method of constructing a house of the type mounted on a pedestal, said house having exterior walls which overhang the perimeter of said pedestal on at least two sides thereof to define at least one vertically unsupported corner and characterized by permitting the unsupported corner or corners of the house to transmit floor, wall and roof loads laterally inwardly to supporting members, and comprising the steps of:

(a) constructing a pedestal to support the house above grade;

(b) constructing a floor truss system from a plurality of intersecting trusses mounted on said pedestal, said truss system extending outwardly beyond the perimeter of the pedestal on at least two sides to define at least one corner area not supported for vertical load transfer;

(c) constructing a floor onto the floor truss system, said floor being constructed of connected-together stress skin panels comprising a core of expanded polystyrene bonded to and sandwiched between relatively thin sheathing;

(d) constructing exterior walls around the perimeter of the floor truss system and onto the floor to define the enclosure of the house, said exterior walls being constructed of stress skin construction panels connected-together to form an integral load-bearing structure supporting its own weight, and the weight of the unsupported corners and transferring the weight thus supported laterally to the load-bearing floor trusses and pedestal; and (e) constructing a roof onto the top of the exterior walls, said roof being constructed of connected-together stress skin construction panels mounted on rafters secured to the top of the exterior walls, said rafters being mounted on vertical load-bearing columns supported by said pedestal and on said walls.

2. A method according to claim 1, wherein said floor truss system is constructed to extend outwardly beyond the perimeter of the pedestal on four sides to define four corner areas not supported for vertical load transfer.

3. A method according to claim 1, wherein said floor truss system is constructed to extend outwardly beyond the perimeter of the pedestal symmetrically on four sides to define four symmetrical corner areas not supported for vertical load transfer.

4. A method according to claim 1, wherein the step of connecting together the wall panels comprises recessing the polystyrene core from the edge of the sheathing along the entire length of the panel to a depth sufficient for the recesses of adjacent panels to collectively receive a spline therebetween for being secured to the panels.

5. A method according to claim 4, wherein the step of connecting together the wall panels comprises the step of providing mating lap joints along the edge of the sheathing material for overlapping adjoining wall panel edges and securing the wall panels in overlapping relation to the spline.

* * * * *